US006600283B1

(12) United States Patent
Platti

(10) Patent No.: US 6,600,283 B1
(45) Date of Patent: Jul. 29, 2003

(54) DEVICE AND METHOD FOR A CONTROLLED GENERATION OF VIBRATIONS

(76) Inventor: Fabrizio Platti, Via Celestino Ferrario 11, I-23814 Cassina Valsassina (IT)

( * ) Notice: Subject to any disclaimer, the term of this patent is extended or adjusted under 35 U.S.C. 154(b) by 0 days.

(21) Appl. No.: 09/830,660

(22) PCT Filed: Oct. 20, 1999

(86) PCT No.: PCT/IT99/00334

§ 371 (c)(1),
(2), (4) Date: Jun. 1, 2001

(87) PCT Pub. No.: WO00/26558

PCT Pub. Date: May 11, 2000

(30) Foreign Application Priority Data

Nov. 4, 1998 (IT) ..... MI98A2370

(51) Int. Cl.[7] ..... E04H 9/02

(52) U.S. Cl. ..... 318/460; 318/128; 318/611; 57/167

(58) Field of Search ..... 318/460, 128, 318/611; 52/167

(56) References Cited

U.S. PATENT DOCUMENTS 4,922,159 A 5/1990 Phillips et al. ..... 318/128
4,935,838 A * 6/1990 Barger et al. ..... 318/114
4,963,804 A * 10/1990 Geiger ..... 318/460
5,182,887 A * 2/1993 Uno et al. ..... 52/167.1
5,713,163 A * 2/1998 Mutaguchi et al. ..... 114/121

FOREIGN PATENT DOCUMENTS

EP 0338933 A 10/1989
JP 01120453 A 5/1989

OTHER PUBLICATIONS

Patent Abstracts of Japan, vol. 013, No. 365 (M–859), Aug. 15, 1989.

* cited by examiner

*Primary Examiner*—Rita Leykin
(74) *Attorney, Agent, or Firm*—Gibbons, Del Deo, Dolan, Griffinger & Vecchione

(57) ABSTRACT

The device for the generation of vibrations comprises an external casing provided with means of connection to a support structure and at least one mobile internal mass housed in the casing. The device is also provided with magnetic means of guidance of the mobile internal mass with respect to the casing; means of establishing the position and/or the motion of the same mobile mass with respect to the casing, and means of automatic control of the magnetic means of guidance. Furthermore, the mobile internal mass comprises at least one magnetically active element.

23 Claims, 6 Drawing Sheets

DEVICE AND METHOD FOR A CONTROLLED GENERATION OF VIBRATIONS

TECHNICAL FIELD

The object of the present invention is a device and a method for the controlled generation of vibrations by magnetic means, which can be used as a damper or exciter of vibrations.

EXISTING TECHNIQUE

In numerous industrial applications, for instance in machining metal by mechanical operations, it is useful to damp vibrations, both free and forced, generated by machine tools.

In the case of cut operations in particular, the reduction of vibrations is a critical factor both in rough-cutting and in finishing. It is desirable to have a high cutting speed, which brings with it an increase in vibrations, but simultaneously maintain high precision of workmanship, which instead requires the limitation of the vibrations generated.

It is common practice to reduce the vibrations caused in a machine tool by means of passive dampers, the simplest of which consists of the employment of masses of considerable weight (plinths) fixed to the faceplate of the same machine tool.

But such means of damping are often revealed to be inadequate in the case of precision and/or high-speed working, since they are not sufficiently effective in reducing the vibrations of the structure and are usually only able to reduce low-frequency oscillations.

Active-agent vibratory devices have therefore been proposed which function according to the "destructive interference" principle, by which it is possible to reduce and theoretically eliminate the oscillations present in a structure by generating new oscillations in the same structure which have the same frequency as the first, but are opposite in phase.

Devices which operate according to the aforementioned principle, usually comprise means for the generation of vibrations subject to automatic controllers which are based on signals relating to vibrations present in the structure to be stabilised, and which supply the necessary opposite phase oscillation.

For these devices to be efficient, it is necessary that the means of generation of vibrations be very rapid in varying the oscillation produced in conformity with the signals furnished by the control system. For this reason such means of vibration generation usually operate electromagnetically, along multiple axes.

The European patent No. 338,933 describes a device for the generation of controlled vibrations, comprising an internal spherical body placed inside a hollow casing, at least six magnetically-active bearing elements, located internally in the casing, means of detecting the vibrations, elements for detecting the position of the internal body and circuits for the automatic control of the magnetic-bearing elements.

The hollow casing is made integral to the structure to be stabilised by means of mechanical fixing elements, such as screws and bolts, while the internal spherical body, which comprises elements in ferromagnetic material, is suspended by means of the magnetic-bearing elements, so that there is no contact between the casing and the same body.

The control circuit, based on the signals deriving from the means of detection, provides for the modification of the intensity of current circulating in the bearing elements, and therefore the magnetic field generated by them.

This means that the forces of attraction to which the internal body is subject change with time in accordance with the signals generated by the control circuit, causing accelerated motion of the internal body with respect to the casing.

The consequent force of reaction acting on the hollow casing causes a vibration which is propagated to the structure to be stabilised.

In this way the control circuit, which operates according to a feedback process, is able to regulate the vibrations caused by the movement of the internal mass with the objective of reducing the oscillations of the structure to which the casing is attached.

While the employment of an internal mass comprising ferromagnetic material, e.g. one or more ring armatures in ferrous material, simplifies the construction of the device on the one hand, on the other it makes it less efficient. In fact, ferromagnetic material is subject to frequent cycles of hysteresis which involve, beyond the dissipation of energy, also a low response speed to the forces generated by the magnetic bearings and, consequently certain limitations in the operating frequency range of the device.

Furthermore, the forces generated by the magnetic bearings are only of attraction and they accordingly must be sufficiently large to overcome the inertia of the large mass of the internal body.

DESCRIPTION OF THE INVENTION

One objective of the present invention is to realise a device for the controlled generation of vibrations which has a high speed of response to the signals which originate from the means of automatic control.

Another objective of the invention is to supply a device for the controlled generation of vibrations which acts on a wide range of frequencies.

A further objective of the invention is to propose a method for the generation of vibrations which is particularly effective, even in the presence of high operating frequencies.

These objectives are achieved by the device for the generation of vibrations characterised according to claim 1 and by the method for the generation of vibrations according to claim 17.

Further characteristics of the invention are described in the remaining dependent claims.

The device for the generation of vibrations according to the invention presents an external casing, provided with means of connection to a support structure, and a mobile mass housed within the casing. The mobile mass comprises at least one active magnetic element, such as a permanent magnet or an electromagnet or a combination of the two, which cooperate with magnetic means of guidance, which are housed in the internal surface of the casing.

The magnetic means of guidance are slaved to means of automatic control, which are in their turn connected to means of detecting the position and/or the motion of the mobile internal mass.

The employment of the same means of detecting the position and/or the motion of the mobile internal mass produces a device which is particularly simple to install, and which doesn't present elements external to the casing to be positioned along the support structure.

According to a particular embodiment of the invention, the device is provided with means of detecting the vibrations of the support structure, operationally connected to the means of control. Such means of detecting the vibrations of the support structure could be suitably placed in correspondence to a support base of the device, and isolated from the latter, to guarantee simplicity of installation and, at the same time, avoid unwanted errors of detection.

In particular, combining the means of detecting the position and/or the motion of the internal mass with the means of detecting the vibrations in the support structure proves particularly useful in obtaining high-precision response of the device to variations in the vibrations in the support structure.

In one possible embodiment of the device, the mobile internal mass is substantially cylindrical.

In a further embodiment, the device according to the invention comprises magnetic means of suspension of the mobile internal mass coincident with the aforesaid magnetic means of guidance.

According to another aspect of the invention, the magnetic means of guidance and suspension comprise windings of conductor material, which present cores substantially devoid of ferromagnetic material.

This solution allows the weight of the external casing to be reduced and a higher frequency response speed of the device to be obtained.

BRIEF DESCRIPTION OF THE SKETCHES

Some preferred embodiments of the invention will be shown, by way of example and not of limitation, in the attached figures, in which.

PREFERRED EMBODIMENTS

Figure 1:
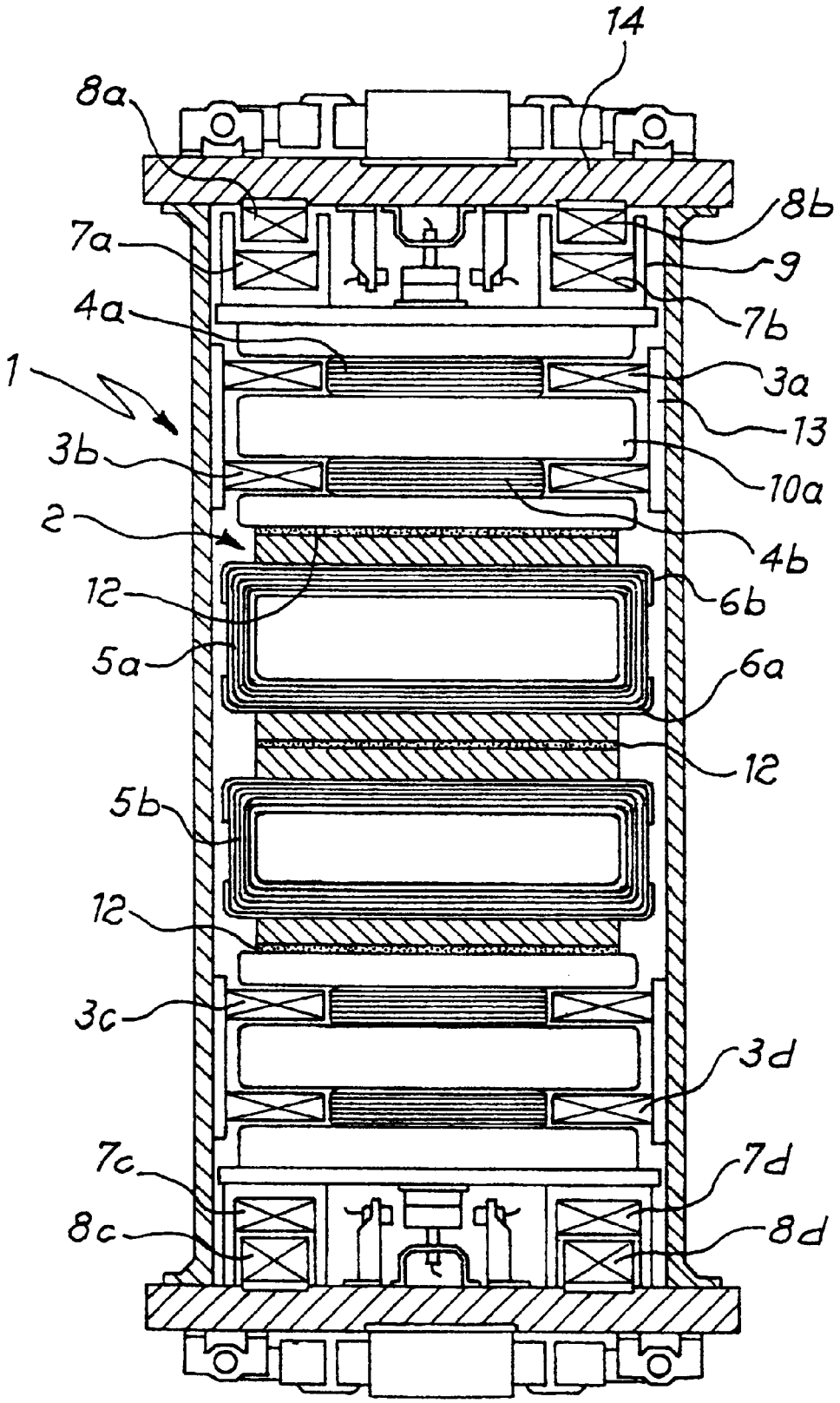
FIG. 1 is a view in elevation and in section of the device according to a preferred embodiment of the invention.
Figure 5:
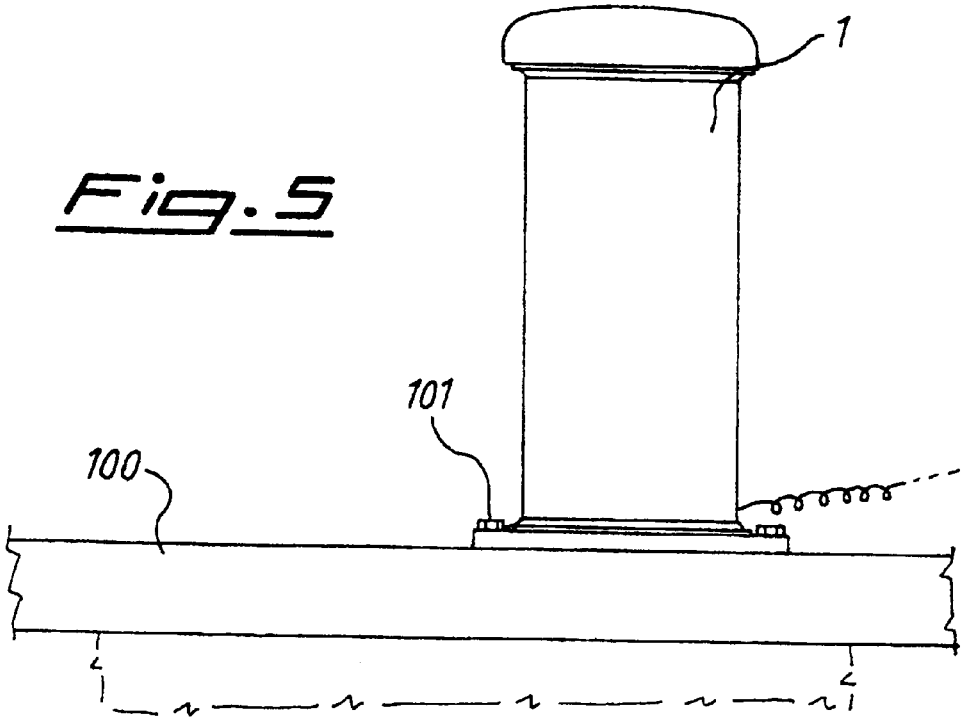
FIG. 5 is a view of the entire device attached to a support structure.

With reference to FIGS. 1 and 5, the device for the controlled generation of vibrations comprises an external casing 1 fit to be attached, by means of fixings 101, to a support structure 100.

Along the internal surface of the casing 1, and integral with it, are side support elements 13 supporting the solenoid windings 3*a*, 3*b*, 5*a*, 5*c*, 5*b*, 5*d*, 3*c* and 3*d*, and extremity supports 14 on which are arranged two coils 8*a*–8*b*, 8*c*–8*d*.

The solenoid windings 3*a*, 3*b*, 3*c* and 3*d* present axis of symmetry perpendicular to the axis of the windings 5*a* and 5*b* and are arranged in corresponding pairs (3*a*–3*b* and 3*c*–3*d*) with respect to the vertical axis of the device.

Figure 3:
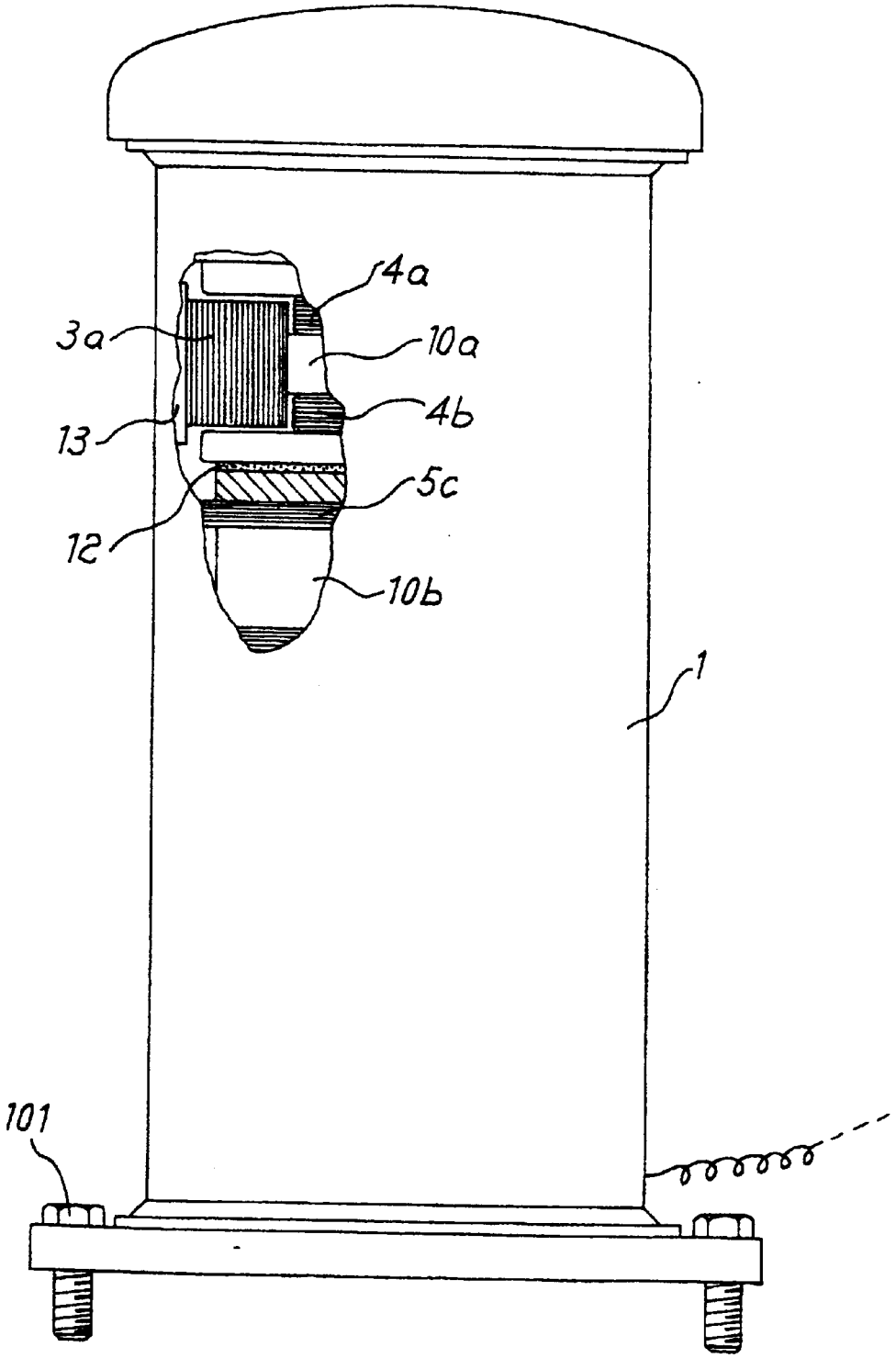
FIG. 3 is a side view, partially exploded, of the device of FIG. 1.

Similarly, the windings 5*a* and 5*b* also present corresponding windings 5*c* (partially visible in FIG. 3) placed symmetrically with respect to the vertical axis of the device.

Inside the casing 1 there is housed a mobile mass 2, free to move along three orthogonal axes with respect to the casing 1, whose position and/or condition of motion is detected by means 11 placed in correspondence to the extremities of the casing 1, and integral with them.

Figure 2:
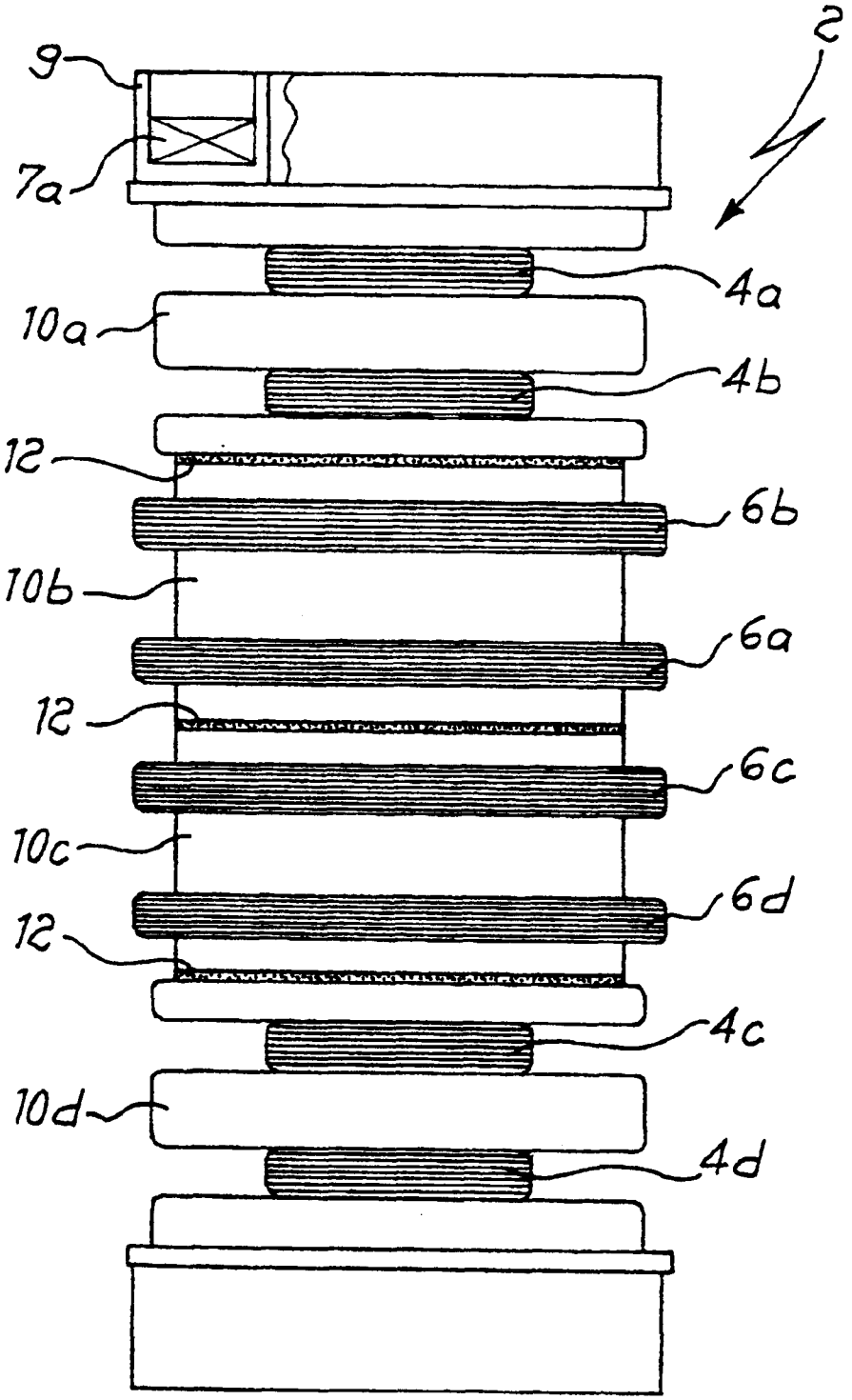
FIG. 2 is a view in elevation of the mobile internal mass of the device shown in FIG. 1.

With reference to FIGS. 1 and 2, the mobile internal mass 2 presents a support frame comprising elements of support 10*a*, 10*b*, 10*c*, 10*d*, in ferromagnetic material, and elements of separation 12 of the magnetic fields, reolised preferably in magnetically screening material.

The elements of support 10*a*, 10*b*, 10*c* and 10*d* constitute the cores of solenoid windings 4*a*, 4*b*, 6*a*, 6*b*, 6*c*, 6*d* and 4*c*, 4*d* integral with the mobile mass 2, placed respectively in correspondence to the windings 3*a*, 3*b*, 3*c*, 3*d* and 5*a* and 5*b*.

In particular, each support element 10*a* supports two windings 4*a* and 4*b* and is separated from the following support element 10*b* by an element 12, preferably in magnetically screening material.

The solenoid windings 4*a*, 4*b* and 6*a*, 6*b* are furthermore disposed in such a way as to present axis of symmetry perpendicular to the axis of the windings 3*a*, 3*b* and 5*a*, 5*b*.

Corresponding to the extremities of the mobile mass 2, there are present cores 9 which support two coils 7*a*–7*b*, 7*c*–7*d* located in correspondence to the coils 8*a*–8*b* and 8*c*–8*d*, integral with the casing 1.

Figure 4:
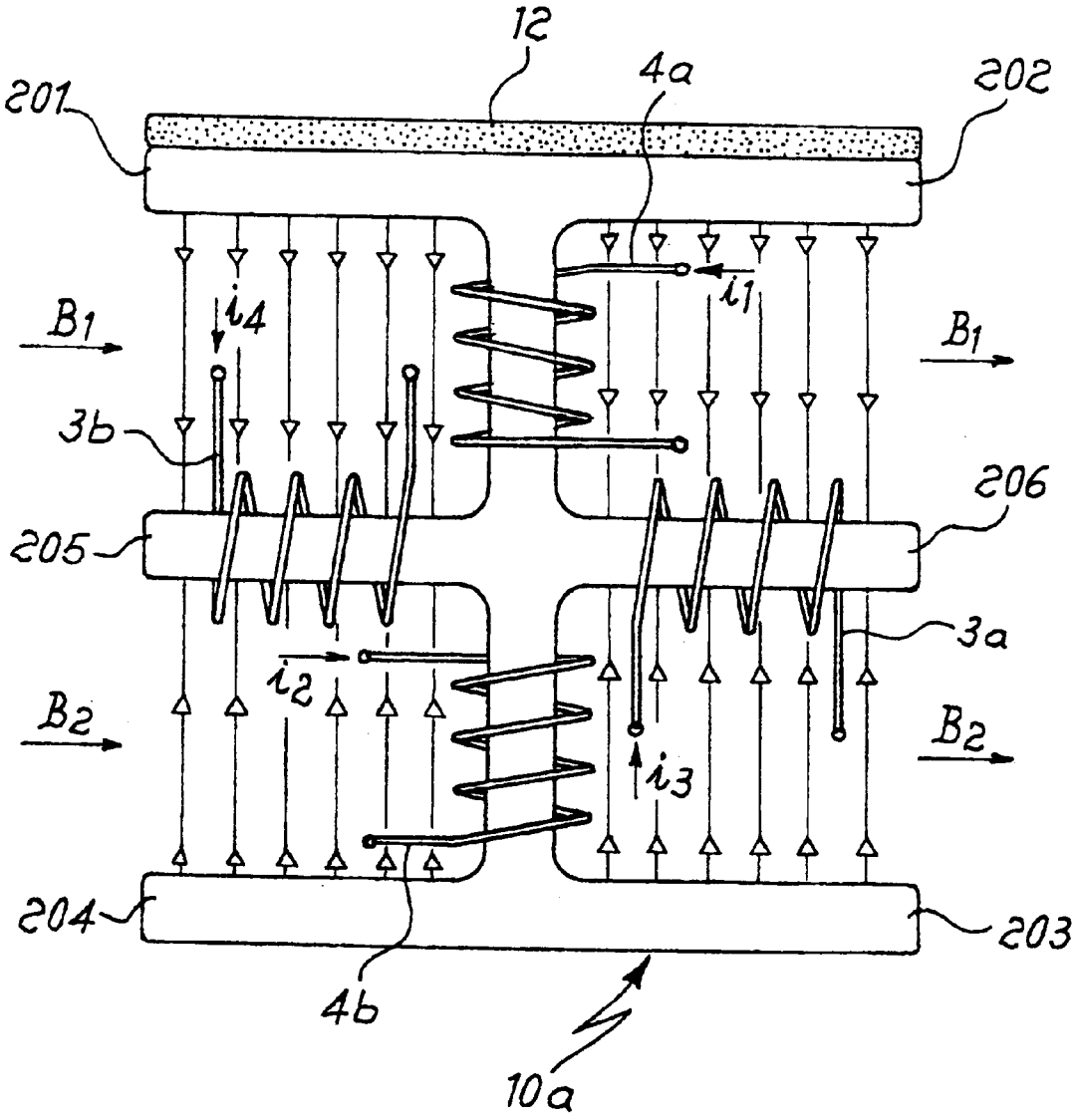
FIG. 4 is a schematic view of an element constituting the mobile internal mass, according to the particular embodiment illustrated in the preceding figures.

As is illustrated schematically in FIG. 4, the support element 10*a* to which are attached the solenoid windings 4*a* and 4*b*, is so shaped as to present polar expansions 201, 202, 203, 204, 205, 206 which extend as far as they are in correspondence to the windings 3*a* and 3*b*, integral with the casing 1.

FIG. 4 also shows the magnetic induction vectors B1 and B2 of the magnetic fields generated respectively by the solenoids 4*a* and 4*b*, when they are crossed by electric current having intensity i1 and i2 respectively.

Advantageously, to avoid demagnetisation of the system, the windings 4*a* and 4*b* could be fed with electric current whose intensity varies with time, in order to maintain the magnetic flux in the structure substantially constant.

The forces of attraction or repulsion which develop in the magnetic circuit formed from the windings 3*a*, 3*b*, 4*a*, 4*b* and from the core 10*a*, according to Laplace's Second Law of Electromagnetism, are proportional to the magnetic induction B1 and B2 of the magnetic fields generated by the electric currents i1 and i2 circulating in the turns of the solenoids 4*a* and 4*b* and to the intensity of the current i3 and i4 circulating in the windings 3*a* and 3*b*, while the direction of such forces is perpendicular to the vectors B1 and B2 and to the direction of circulation of the current in the windings 3*a* and 3*b*.

The creation of magnetic fields with induction vectors B1 and B2 which have the same direction but opposite sense, and the circulation in the same sense of current in the windings 3*a* and 3*b*, cause forces acting on each solenoid winding 3*a* and 3*b* in the same direction and in the same sense, according to the well known second law of Laplace.

This causes the winding 3*a* to be subject to a force of attraction toward the core 10*a* and simultaneously the winding 3*b* to be subject to a force of repulsion away from the same core 10*a*, or which causes the core 10*a* and the windings 4*a* and 4*b* integral with it, to be attracted to the winding 3*a* and simultaneously repulsed from the winding 3*b*.

Changing the sense of circulation of the current i3 and i4 which cross the windings 3*a* and 3*b* it is possible to reverse the sense in which the forces of attraction and repulsion act and therefore move the core 10*a*, and the windings 4*a* and 4*b* integral with it, in opposite senses.

As illustrated in FIG. 2, the mobile mass 2 comprises at least two support elements 10*a* and 10*d* which act to generate forces of attraction or repulsion, on the basis of the second law of Laplace, in a first direction, and at least two elements of support 10*b* and 10*c* which act to generate forces of attraction or repulsion in a second direction perpendicular to the first.

There are furthermore present on the extremities of the mobile mass 2, the two coils 7*a*–7*b* and 7*c*–7*d* coupled respectively with two coils 8*a*–8*b* and 8*c*–8*d* to generate forces of attraction or repulsion also in the direction of the vertical axis of the device, perpendicular to the two directions mentioned above.

The forces of attraction or repulsion acting in the direction of the vertical axis of the device can be employed to suspend the mobile mass 2 magnetically with respect to the casing 1, so that there is no contact between the parts. It is also possible to provide mechanical means of suspension of the mobile mass 2 with respect to the casing 1, while still maintaining the magnetic means 7*a*–7*b*, 8*a*–8*b* and 7*c*–7*d*, 8*c*–8*d*, which allow the movement of the mass 2, along the vertical axis of the device.

If the sense of action of the forces of attraction or repulsion is reversed with constant frequency, the mobile mass 2 could be placed in periodic motion inside the casing 1 and generate, by the principle of action and reaction, vibrations in the casing 1, which are transmitted to the support element 100, to which the casing 1 is fixed.

By, controlling the direction and the intensity of current circulating in the solenoid windings 3*a*, 3*b*, 3*c*, 3*d*, 5*a*, 5*b*, 5*c*, 5*d*, 8*a*–8*b* and 8*c*–8*d* attached to the casing 1, it is possible to suspend and move the mobile mass 2 magnetically to cause vibrations along three orthogonal axes, with the required characteristics of amplitude, frequency and phase.

The employment of an automatic controller, suitably configured, which acts on the,basis of the signals deriving from the means 11 for detecting the position and/or of the motion of the mobile mass 2 with respect to the casing 1, allows the device to act as a damper of vibrations.

In fact, when the support structure 100 (in FIG. 5), and therefore also the casing 1 integral with it, is subject to oscillations, the mobile mass 2, suspended magnetically, vibrates with respect to the casing 1.

This vibration, proportional to the vibration of the support structure 100, is converted into an electrical signal by the means of detection 11. The electrical signal deriving from the means 11, in its turn, is filtered, then amplified and sent as the input signal to an automatic controller.

The automatic controller, which governs the sense and the intensity of current circulating in the windings of the device on the basis of the aforementioned electrical signals, sets the mobile mass 2 in motion in agreement with the direction and sense of the oscillation present on the structure 100, so that the force of reaction acting on the casing 1 generates vibrations of the same frequency as those pre-existing in the structure, but which are propagated with opposite phase in the controlled structure, in accordance with the "destructive interference" principle.

According to a particular aspect of the invention, a heat exchange fluid is provided to be set in circulation in the space between the casing 1 and the mobile mass 2, to favour the dispersion of the heat generated by the Joule effect in the findings.

According to another aspect of the invention, mechanical limit stops are provided to prevent the mobile internal mass 2 bumping destructively against the casing 1.

The device thus described, furthermore, could be used with a support structure 100 subject to oscillations in a certain direction, by imposing the mobile internal mass 2 vibration with a component oriented in a different direction with respect to the direction of motion engaged by the same support structure 100.

That allows the simultaneous suppression of the oscillation to which the support 100 is subject and the generation of vibrations, always in the support 100, along a direction different from the direction of suppression. The device can therefore simultaneously cause and damp vibrations in different directions.

Figure 6:
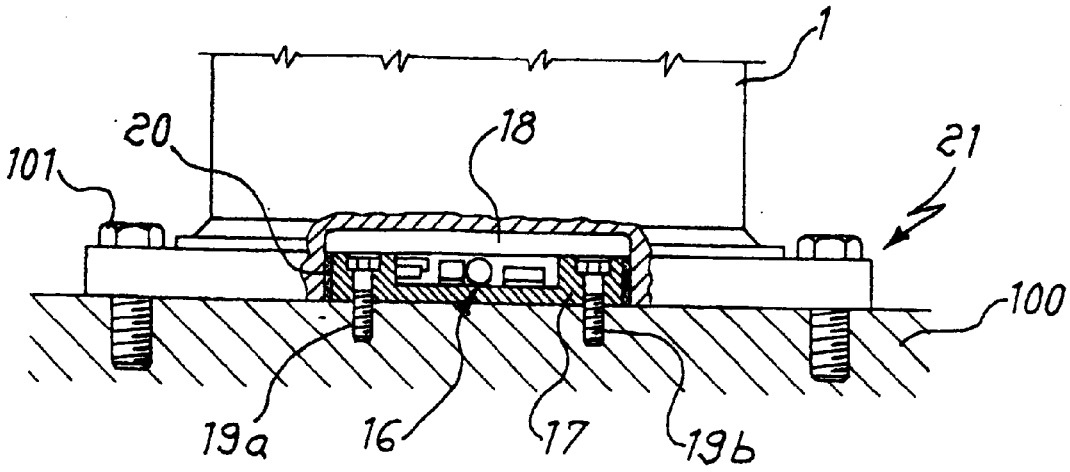
FIG. 6 is a section of the support base of a device according to the present invention.

FIG. 6 illustrates a section of the support base of a further embodiment of the device according to the present invention, comprising means of detecting the vibrations 16 in the support structure 100, constituted for instance by accelerometers, connected operationally to the aforesaid means of automatic control.

In the particular embodiment illustrated, the accelerometers 16, which detect variations in speed of the support structure 100 with respect to three orthogonal axes, are arranged on a baseboard 17 which is housed in a cavity 18 in the lower support base of the casing 1 of the device. This baseboard 17 is constrained to the support structure 100 by means of the screws 19*a* and 19*b*, to make integral the accelerometers 16 to the same support structure. Between the baseboard 17 and the walls of the cavity 18 is interposed an elastic gasket 20 to uncouple the accelerometers 16 mechanically and thermally from the casing 1.

FIG. 6 show furthermore means of fixing 21 of the device to the support structure 100, constituted by screws which engage in corresponding nut threads set into the same support structure 100. According to a further embodiment of the present invention, whenever the support structure 100 is in ferromagnetic material, the means of fixing 21 the casing 1 to the support structure 100, are of electromagnetic two-state activation type. Such means of fixing 21 comprise at least one ferromagnetic element 22 (FIG. 7) which presents a high force of magnetic coercion and which has a hysteresis cycle provided with a point of demagnetisation. Therefore, when this ferromagnetic element is subjected to a first field of magnetisatiort for a predefined period of time and then removed from such a field of magnetisation, the element will display residual magnetisation typical of permanent magnets. Subsequently subjecting the magnetised element to a second magnetic field (of demagnetisation), the reverse of the first, for the magnetic properties of the ferromagnetic element, when it is taken away from the second field, this element will display substantially no trace of residual magnetisation. The magnetising and demagnetising fields of the ferromagnetic element can easily be generated by electromagnetic means.

It is also possible to employ electromagnetic means of fixing 21 of the casing 1 to the structure 100, of the type requiring continuous supply of current, for instance comprising at least one solenoid winding to generate a suitable magnetic field.

Figure 7:
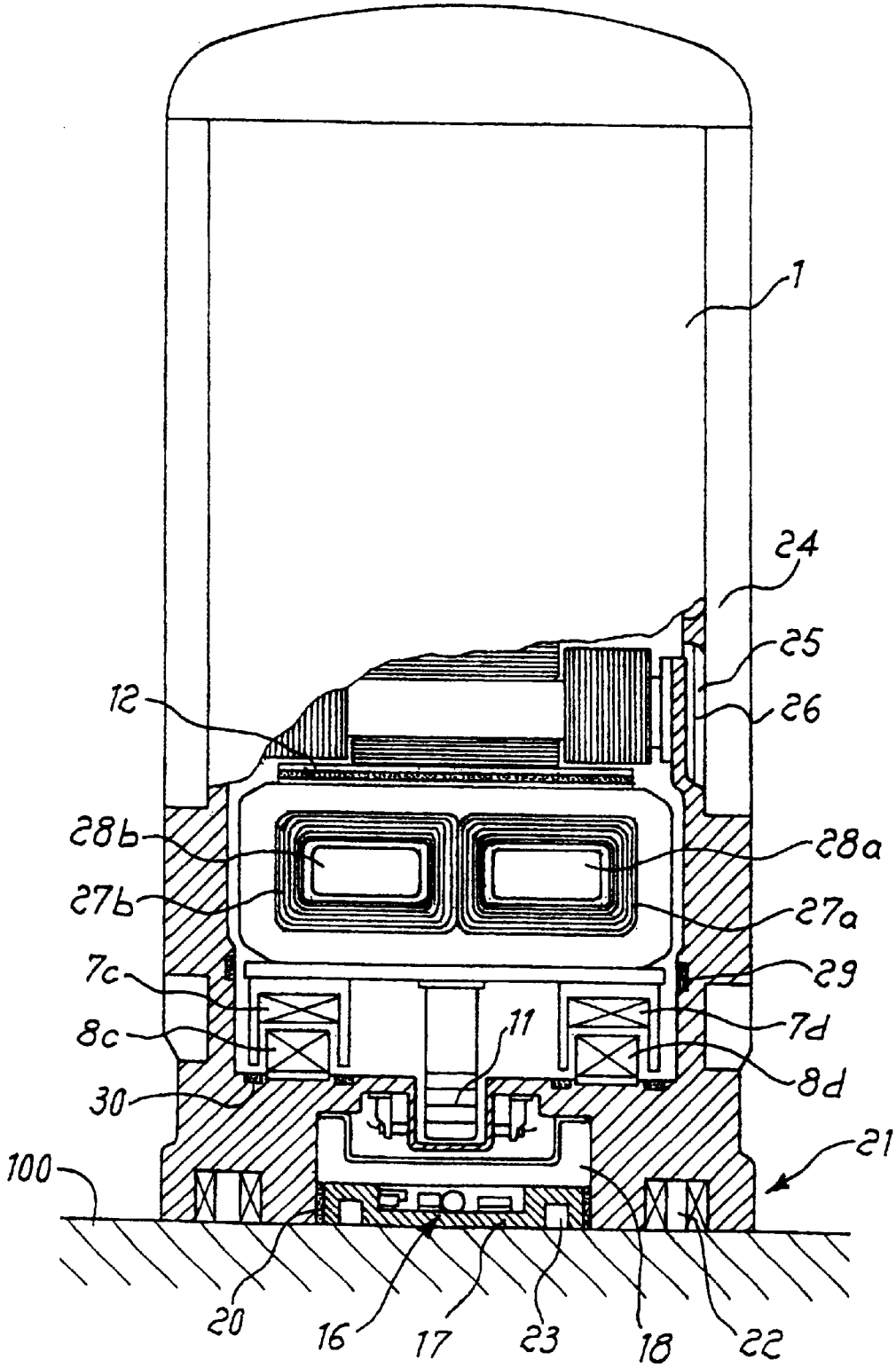
FIG. 7 is a view in partial section of another embodiment of the device according to the present invention.

FIG. 7 presents a view in partial section of a different embodiment of the device according to the present invention.

The device shown comprises means of fixing 21 of the casing 1 to the support structure 100, of electromagnetic two-states activation type, described above.

Corresponding to the base of support of the device, a cavity 18 is provided within which is housed a support baseboard 17 for accelerometers 16, to detect the vibrations existing in the support structure 100. This baseboard 17 is fixed to the same structure 100 by means of fixing 23 of electromagnetic two-states activation type of support, described above.

The device comprises, in proximity to the internal side surface, at least one compensation chamber 25, equipped with an elastic membrane 26, which has the function of compensating variations in volume of the cooling fluid. The internal surface of the casing 1, furthermore, presents elastic limit-stop elements 29, 30 to prevent damage to the same device being caused by the mobile internal mass 2 bumping against the casing 1. The external casing 1 can, furthermore, be provided with fins 24, to increase the dispersal of heat generated during use of the device.

As partially shown in FIG. 7, instead of only one winding integral with the casing 1, for each direction of movement of the internal mass 2 perpendicular to the vertical axis of the same, there could be two parallel windings 27*a* and 27*b* provided, powered separately, which operate respectively within the polar expansions 28*a* and 28*b* of the support frame of the mobile internal mass 2, also parallel to each other. This allows more precise regulation of the forces to which the mobile internal mass is subject and contributes to eliminating undesirable rotations of the same.

The employment of magnetically active elements, which constitute the mobile internal mass 2, allows forces of attraction or repulsion to be applied in conformity with the second law of Laplace, having the same direction and sense in agreement on the structure, which guarantee the rapid response of the device to the signals deriving from the automatic controller and the attainment of high operating frequencies.

Furthermore, the layout of the magnetically active elements which constitute the mobile mass 2 doesn't generate undesirable couples on the device but, on the contrary, allows couples induced by the source of vibrations to be controlled quite easily.

What is claimed is:

1. A device for the generation of vibrations comprising an external casing provided with means for the connection to a support structure, at least one mobile internal mass housed in said external casing, magnetic means for placing in motion and guiding said mobile internal mass with respect to said external casing, means for detecting the motion and/or the position of said mobile internal mass with respect to said external casing, and means for automatic control of said magnetic means for placing in motion and guiding said mobile internal mass, in which said mobile internal mass comprises at least one magnetically active element.

2. A device for the generation of vibrations according to claim 1, characterized in that said magnetically active element comprises at least one permanent magnet.

3. A device for the generation of vibrations according to claim 1, characterized in that said magnetically active element comprises at least one electromagnet.

4. A device for the generation of vibrations according to claim 1, characterized in that said magnetically active element comprises at least one permanent magnet and at least one electromagnet.

5. A device for the generation of vibrations according to claim 1, characterized in that said mobile internal mass comprises at least two magnetically active elements mechanically coupled in correspondence to a same pole.

6. A device for the generation of vibrations according to claim 1, further comprising magnetic means for suspension of said mobile internal mass with respect to said casing.

7. A device for the generation of vibrations according to claim 6, characterized in that said magnetic means for suspension and said magnetic means of guidance of said mobile internal mass coincide.

8. A device for the generation of vibrations according to claim 1, further comprising means for detecting the vibrations of said support structure.

9. A device for the generation of vibrations according to claim 8, characterized in that said means for detecting the vibrations comprise at least one accelerometer.

10. A device for the generation of vibrations according to claim 8, characterized in that said means for automatic control are operationally connected to said means for detecting the vibrations to receive information.

11. A device for the generation of vibrations according to claim 8, characterized in that said means for detecting the vibrations are arranged in correspondence to a base of support of said external casing on said support structure, integral to said support structure and separated from said casing by elastic means.

12. A device for the generation of vibrations according to claim 1, characterized in that said mobile internal mass is substantially cylindrical.

13. A device for the generation of vibrations according to claim 1, characterized in that said magnetic means, in association with said casing, for the guidance of said mobile internal mass comprise internal windings in conducting material, substantially devoid of ferromagnetic cores.

14. A device for the generation of vibrations according to claim 1, further comprising a heat exchange fluid circulating in the space between said casing and said mobile internal mass.

15. A device for the generation of vibrations according to claim 1, characterized in that said casing comprises elastic limit-stop elements for said mobile internal mass.

16. A device for the generation of vibrations according to claim 1, characterized in that said means for the connection to a support structure comprise magnetically operated means of fixing.

17. A method for the generation of vibrations, comprising producing forces on an external casing by controlling a relative motion of at least one mobile internal mass housed inside said casing, placing in motion and guiding said mobile internal mass magnetically with respect to said external casing, and automatic controlling at least one magnetically active element in association with said mobile internal mass to generate said forces on said external casing.

18. A method for the generation of vibrations according to claim 17, characterised in that said automatic control of at least one magnetically active mass comprises the simultaneous exercise of forces of attraction and repulsion on said magnetically active element.

19. A method for the generation of vibrations according to claim 17, characterized in that said mobile internal mass is arranged in a free-floating way inside said external casing.

20. A method for the generation of vibrations according to claim 17, characterized in that said automatic controlling of at least one magnetically active element occurs according to a feedback process, based on signals deriving from at least means for detecting the motion and/or the position of the mobile internal mass with respect to said external casing.

21. A method for the generation of vibrations according to claim 17, characterized in that the automatic controlling of said magnetically active element occurs by means of windings set internally on said external casing, supplied with current varying in time.

22. Use of a device for the generation of vibrations according to claim 17, further comprising fixing the external casing to a support structure, and dampening of pre-existing induced vibrations on said support structure.

23. Use of a device for the generation of vibrations according to claim 22, further comprising oscillating said support structure in a direction of movement of said support structure, and generating vibrations in a different direction with respect to the direction of movement of said support structure.

* * * * *